US011346106B2

(12) United States Patent
Subacchi et al.

(10) Patent No.: US 11,346,106 B2
(45) Date of Patent: May 31, 2022

(54) PRE-COMPRESSION SYSTEM FOR PRE-COMPRESSING A STRUCTURE

(71) Applicant: FSC TECHNOLOGIES LLC, Davenport, FL (US)

(72) Inventors: Claudio Subacchi, Davenport, FL (US); Giovanni Ferri, Solignano (IT)

(73) Assignee: FSC TECHNOLOGIES LLC, Davenport, FL (US)

( * ) Notice: Subject to any disclaimer, the term of this patent is extended or adjusted under 35 U.S.C. 154(b) by 0 days.

(21) Appl. No.: 17/049,109

(22) PCT Filed: Apr. 25, 2019

(86) PCT No.: PCT/US2019/029189
§ 371 (c)(1),
(2) Date: Oct. 20, 2020

(87) PCT Pub. No.: WO2019/212862
PCT Pub. Date: Nov. 7, 2019

(65) Prior Publication Data

US 2021/0238852 A1 Aug. 5, 2021

(30) Foreign Application Priority Data

May 4, 2018 (IT) ..... 102018000005076

(51) Int. Cl.
*E04C 5/10* (2006.01)
*E04C 5/08* (2006.01)

(52) U.S. Cl.
CPC ..... *E04C 5/10* (2013.01); *E04C 5/085* (2013.01)

(58) Field of Classification Search
CPC ... E04C 5/08; E04C 5/085; E04C 5/10; E04C 5/127
See application file for complete search history.

(56) References Cited

U.S. PATENT DOCUMENTS 1,965,748 A * 7/1934 Mitchell ..... B28B 21/62 264/516
3,202,740 A * 8/1965 Patin ..... B28B 23/043 264/228
3,231,442 A * 1/1966 Michael ..... B29C 53/845 156/155

(Continued)

FOREIGN PATENT DOCUMENTS

AU 2011379962 A1 6/2014
CN 101148068 A 3/2008

(Continued)

*Primary Examiner* — James M Ference
(74) *Attorney, Agent, or Firm* — Pearne & Gordon LLP

(57) ABSTRACT

A pre-compression system for pre-compressing a concrete structure, the system comprising a first tubular element (31) that is expandable in a longitudinal direction and interposed between the first and the second head (21, 22). The first tubular element (31) is movable between a longitudinally elongated configuration, in which a pressurized fluid is placed inside the first tubular element (31), and a contracted configuration, in which said fluid is at least partly removed, the passage from the elongated configuration to the contracted configuration bringing about a compression on the concrete which at least partly envelops the first tubular element (31).

6 Claims, 3 Drawing Sheets

(56) References Cited

U.S. PATENT DOCUMENTS 3,513,609 A * 5/1970 Lang ..... E04C 5/08 52/223.6
3,731,367 A * 5/1973 Laussermair ..... F16C 15/00 29/447
3,948,010 A * 4/1976 Sonneville ..... B28B 23/043 52/223.13
4,079,165 A * 3/1978 Morley ..... B29C 70/08 14/22
4,217,158 A * 8/1980 Puck ..... B29C 53/8016 156/156
4,247,516 A * 1/1981 Morgan ..... B28B 21/34 264/228
4,544,428 A * 10/1985 Mandel ..... B29C 53/8066 156/161
4,587,684 A * 5/1986 Miller ..... E01D 4/00 14/15
4,589,562 A * 5/1986 Fawley ..... B29C 63/24 220/590
4,771,530 A * 9/1988 Creedon ..... B28B 21/62 138/109
4,936,006 A * 6/1990 Creedon ..... B28B 11/00 264/228
7,896,998 B2 * 3/2011 Pallini ..... B29C 63/10 156/160
8,440,034 B2 * 5/2013 Pallini ..... B29C 63/10 156/80
9,938,721 B2 4/2018 Kurath-Grollmann
10,036,488 B2 * 7/2018 Taylor ..... B29C 66/1122
10,059,032 B2 8/2018 Adam
10,246,887 B2 4/2019 Motavalli et al.
10,850,427 B2 12/2020 Pedretti-Rodi et al.
2006/0096993 A1 * 5/2006 Takashima ..... F17C 1/06 220/588
2009/0050730 A1 * 2/2009 Pallini ..... B29C 63/10 242/438
2011/0139341 A1 * 6/2011 Pallini ..... B29C 63/10 156/80
2012/0282025 A1 * 11/2012 French ..... B28B 23/04 404/45
2013/0255821 A1 * 10/2013 Roberts ..... F16L 11/08 138/177
2013/0263964 A1 * 10/2013 Jones ..... B29C 70/20 138/174
2013/0263965 A1 * 10/2013 Jones ..... F16L 51/00 138/174
2013/0316104 A1 11/2013 Adam
2014/0099456 A1 * 4/2014 Raghavendran ..... B32B 13/02 428/34.4
2014/0205496 A1 * 7/2014 Kharshan ..... C23F 11/02 422/9
2015/0267408 A1 9/2015 Kurath-Grollmann
2015/0330535 A1 * 11/2015 Subacchi ..... F16L 9/14 138/122
2017/0266841 A1 9/2017 Pedretti-Rodi et al.
2017/0268234 A1 * 9/2017 Subacchi ..... B29C 70/023
2017/0314277 A1 11/2017 Motavalli et al.
2018/0179757 A1 6/2018 Kurath-Grollman et al.
2021/0238852 A1 * 8/2021 Subacchi ..... E04C 5/085

FOREIGN PATENT DOCUMENTS

CN 102186654 A 9/2011
CN 104797764 A 7/2015
CN 107000251 A 8/2017
CN 107407100 A 11/2017
CN 109057395 A * 12/2018
WO 2010139045 A1 12/2010

* cited by examiner

PRE-COMPRESSION SYSTEM FOR PRE-COMPRESSING A STRUCTURE

The object of the present invention is a pre-compression system for pre-compressing a structure, typically a concrete structure.

Concrete is a material that does not hold up well to tensile stresses, whereas it does offer good compressive strength. For this reason, pre-compression is known to be performed in the forming stage (a typical application is in concrete beams of large dimensions or in very large pavements). In practice, a metal cable is stretched between two supports and then the concrete is applied around the metal cable shaping it into the desired form. Once it has cured, the cable is disconnected from the two tensioning supports. In this manner, the cable transfers pre-compression to the concrete structure and the pre-compression helps neutralize any tensile loads.

There is an alternative system known as post-compression which comprises the positioning of tendons in special sheaths inside a form for curing the concrete. After the concrete has cured, the tendons placed inside the sheaths are tensioned.

One drawback of these design solutions is the fact that these measures are adopted only for large-scale works in terms of dimensions and costs. In fact, the use of tensioning supports and the method associated with pre-compression/post-compression entail additional costs which are normally avoided in the case of less significant works (such as building homes, which, however, constitute a major portion in the overall use of concrete). Moreover, the realization of pre-compression and post-compression also introduces production issues relating for example to the presence of adequate space for enabling the tensioning supports to be positioned.

An aim of the present invention is to make available a pre-compression system for pre-compressing a structure that makes it possible to minimize costs and the difficulties involved in the installation thereof.

The defined technical task and the specified aims are substantially achieved by a pre-compression system comprising the technical characteristics set forth in one or more of the appended claims.

Further characteristics and advantages of the present invention will become more apparent from the approximate and thus non-limiting description of a pre-compression system for pre-compressing a structure as illustrated in the attached drawings, of which:

In the accompanying figures, a pre-compression system for pre-compressing a structure is indicated by the reference number 1. This structure can comprise concrete (throughout this description, reference is made to concrete by way of example, but the latter could be substituted with a more generic construction material which could comprise/be for example a polymeric structure or CSA cements). The structure can consist of a beam for example, but it could also be a portion of a more complex structure. Following consolidation (curing) of the concrete, the structure undergoes pre-compression, which improve resistance to subsequent tensile loads.

The system 1 comprises a first tubular element 31 that is expandable in a longitudinal direction. The first tubular element 31 has a resistance to radial expansion that is greater than its resistance to longitudinal elongation. In the preferred solution, the first longitudinal element 31 has a rectilinear extension. The first longitudinal element 31 is at least partly submerged in said structure.

The first tubular element 31 is movable between a longitudinally elongated configuration, in which a pressurized fluid is placed inside the first tubular element 31 (thus determining its elongation) and a contracted configuration, in which said fluid is at least partly removed. This takes place after the concrete has cured. The passage from the elongated configuration to the contracted configuration brings about a compression of the concrete which at least partly envelops the first tubular element 31 (given that it tends to return to an undeformed configuration once the action of pressurization of the fluid ceases). This compression involves the direction of the longitudinal extension of the first tubular element 31. The first element 31 can thus be defined as a pressure-activatable tendon. The internal pressure is due to the pressurized fluid introduced by means of a pump. The fluid is introduced into the first tubular element 31 from one of the two ends. Once the first tubular element 31 is filled (advantageously this step can be accompanied by the total removal of air present), only a few $cm^3$ of water will be introduced so as to enable its elongation. Advantageously, the elongation of the first tubular element 31 takes place along a rectilinear direction. In passing from the longitudinally elongated configuration to the contracted configuration, the concrete (already cured) could bring about slight arching along the longitudinal extension of the first tubular element 31.

Figure 1:
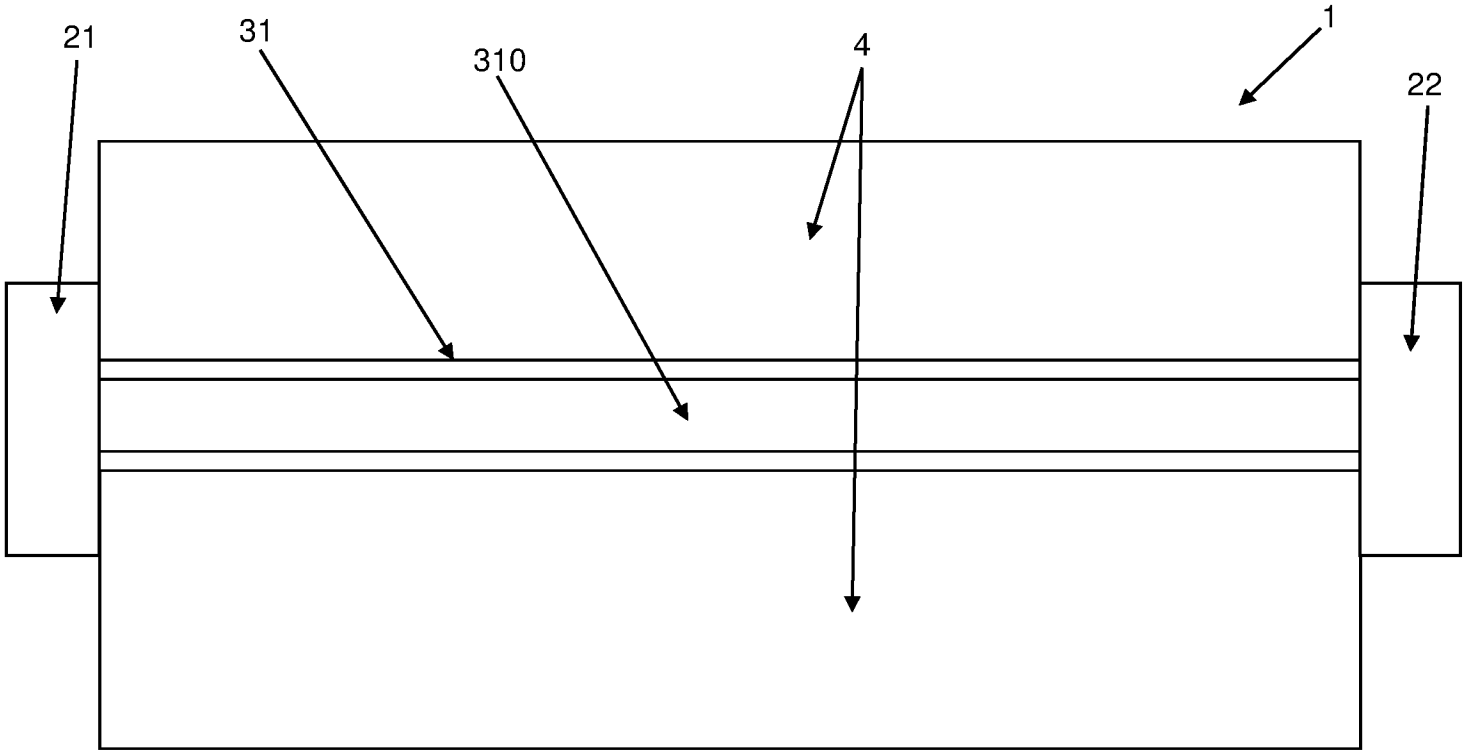
FIG. 1 shows a pre-compression system according to the present invention.
Figure 2:
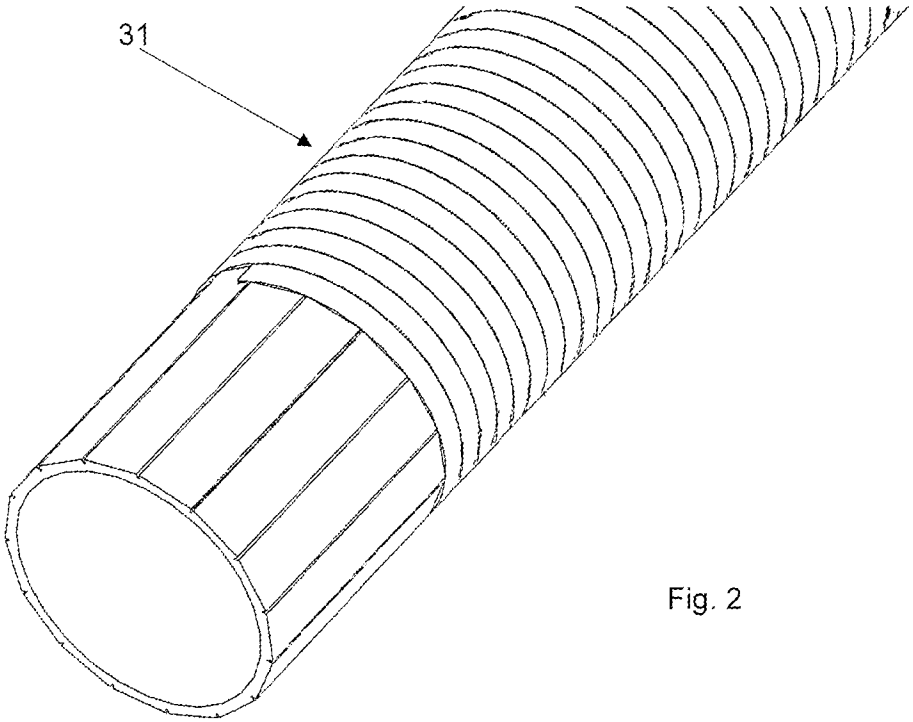
FIG. 2 shows a perspective view of a detail of the pre-compression system.

The pressurized fluid is typically an incompressible fluid, for example a liquid, preferably water. The pressure of the fluid in the elongated configuration could be comprised between 500 and 600 atm for example. The structure, in turn, comprises a first and second compression head 21, 22 for compressing the concrete interposed between them. The first and second head 21, 22 can comprise compression plates for example. For example, the first and the second head 21, 22 could be made of a metal material, for example steel. In an alternative solution, they could be made of UHPC (the acronym for the well-known "Ultra High Performance Concrete"). The first and the second head 21, 22 could be of different shapes, for example, disc-shaped, cross-shaped, L-shaped, T-shaped, etc. In FIG. 1, reference number 4 indicates a layer of concrete that one wishes to pre-compress.

The first tubular element 31 is interposed between the first and the second head 21, 22. In particular, the first tubular element 31 has a first end constrained to the first head 21 and a second end constrained to the second head 22. The first element 31 extends in a longitudinal direction between the first and the second head 21, 22. In particular, the first end of the first tubular element 31 is directly connected with the first head 21. Likewise, the second end of the first tubular element 31 is also directly connected with the second head 22.

In the preferred solution, the compressive action on the concrete is therefore at least partly performed by the first and the second head 21, 22, which, in the contracted configuration, compress the concrete interposed between them.

The first and the second head 21, 22 are therefore important for transmitting the load from the first tubular element 31 to the concrete. In fact, when the pressurized fluid is removed from the first tubular element 31, the transfer of the load by adhesion, though present, could be contained.

In an alternative solution, the first and the second head 21, 22 could also be absent. In this case, compression could be exerted directly by the full-full adhesion/dragging action performed on the concrete by the first tubular element 31 which passes from the longitudinally elongated configuration to the contracted configuration. Advantageously, in this case, the first tubular element 31 could have projections, for example helical grooves. To increase friction between the first tubular element 31 and the concrete, granular elements, for example sand, could possibly be present on the external surface of the first tubular element 31.

The first tubular element 31 comprises a composite material. Preferably, it is entirely made of a composite material. This makes it free of corrosion problems even in the case in which it is intended to be positioned in a shallow area of the structure and thus more easily exposed to the action of the outside air. Advantageously, the first tubular element 31 has a resistance to radial expansion that is greater than its resistance to longitudinal elongation. This is important and it can be achieved by using composite materials. In fact, if filled with a pressurized liquid, the tubular structures made entirely of steel undergo much greater circumferential stress with respect to longitudinal stress. As a result, upon an increase in pressure, there would be breakage of the tubular element (due to the high circumferential stresses) when the elongation is still insufficient to ensure subsequent adequate pre-compression.

The composite material comprises a matrix and fibres located in the matrix.

For example, the matrix can comprise/be one of the following materials: an epoxy matrix, polyester or vinyl ester.

Advantageously, the fibres located in the matrix can comprise/be one of the following materials: basalt fibres, glass fibres or carbon fibres.

Advantageously, the fibres comprise fibres that are wrapped around a longitudinal axis of the first tubular element 31. They radially strengthen the first tubular element 31, making it able to withstand greater circumferential stress (contrasting the radial pressure exerted by the fluid). These fibres wrapped around a longitudinal axis advantageously extend helically. These fibres can possibly be wrapped around the longitudinal axis in the form of a left-handed and right-handed double helix angle.

Conveniently, the fibres also comprise longitudinal fibres. These fibres are responsible for the contraction of the tubular element which determines the passage from the longitudinally elongated configuration to the contracted configuration (thus defining the pre-compression of the concrete).

The fibres wrapped around a longitudinal axis are important during the curing process of the concrete for the purpose of opposing the radial thrust due to the pressurized fluid present in the first tubular element 31. Therefore, as these fibres are stressed for a reduced period of time, they can withstand stresses which, in terms of percentages, are closer to the breaking load than the longitudinal fibres.

Preferably, the percentage by weight of the matrix with respect to the weight of the fibres is comprised between 5% and 50%.

In an alternative solution, the first tubular element 31 could comprise (advantageously be constituted by) impregnated fibres helically wrapped around the longitudinal axis in a right-handed and/or left-handed manner. In this case, there could be various layers with a predetermined helix angle (which could also be different for each layer). The helically wrapped fibres can radially strengthen the first tubular element 31, making it able to withstand greater circumferential stress and they can be responsible for the contraction of the tubular element, passing from the longitudinally elongated configuration to the contracted configuration (making the presence of the longitudinal fibres superfluous).

In an alternative solution, the first tubular element 31 could also comprise a core made of steel or in any case a metal, around which fibres made of a composite material or a wire made of a metal material are wrapped helically. The composite material and/or said metal wire determine a resistance to radial expansion that is greater than a resistance to longitudinal elongation.

Figure 3:
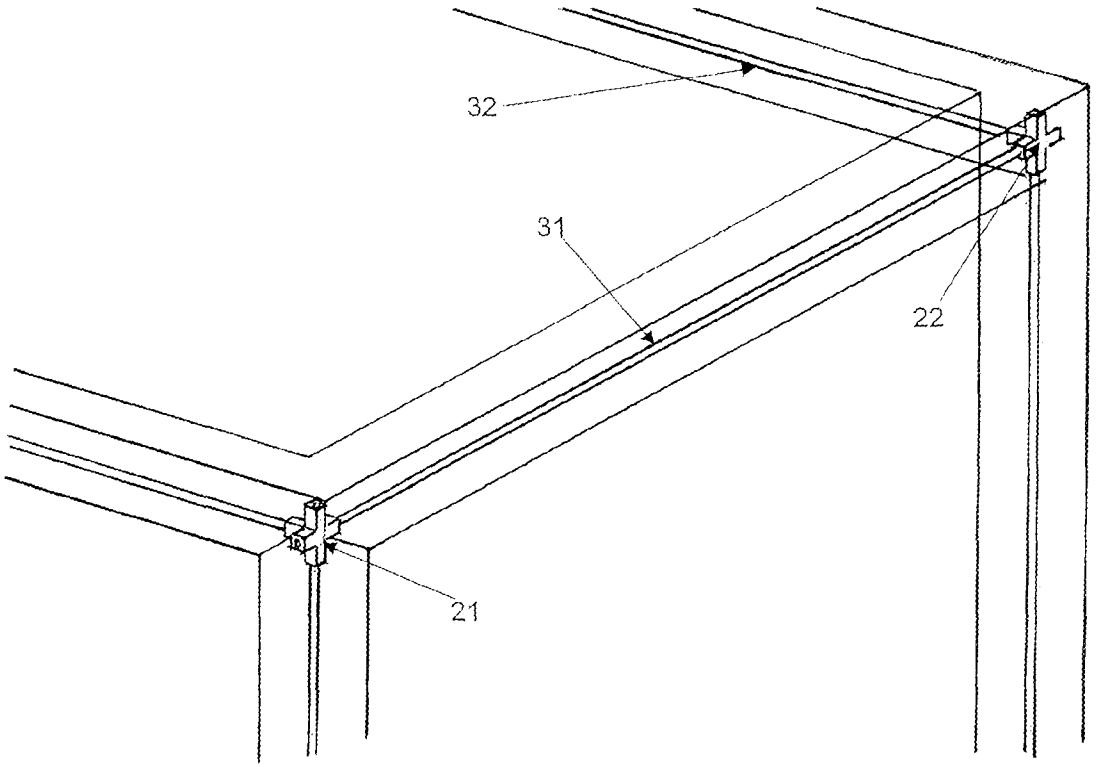
FIG. 3 shows a pre-compression system for pre-compressing a structure according to the present invention.

The system 1 also comprises a second expandable tubular element 32. It extends from the first compression head 21 to a third compression head. In this case, the first and the second tubular element 31, 32 extend along different directions (see for example FIG. 3). Pre-compressions can therefore be carried out in a number of directions at the same time. Preferably, the first and the second tubular element 31, 32 both extend in a rectilinear direction.

In an alternative solution, the first and the second tubular element 31, 32 can extend along the same straight line. In this case, the first head 21 defines a joint between the first and the second tubular element 31, 32. Advantageously, in this case, the first and the second tubular element 31, 32 have different diameters. Different pre-loads can thus be applied.

In the preferred solution, the ratio of the weight (or the strength) of the fibres wrapped around a longitudinal axis of the first tubular element 31 to the weight (or strength) of the longitudinal fibres is in the range of 2 to 1. In a preferred solution, the outer diameter of the first tubular element 31 is comprised between 15 and 50 millimetres, and it is preferably comprised between 16 and 20 millimetres. In a preferred solution, the thickness of the first tubular element 31 is conveniently comprised between 1 and 10 millimetres.

In selecting the geometric parameters stated hereinabove, it should be kept in mind that they depend on the loads involved. In the construction of residential buildings, the pre-compression loads are lower than in a bridge beam, for example.

One or more of the characteristics described with reference to the first tubular element 31 and/or to the interaction thereof with two end heads can be repeated for the second tubular element 32.

The object of the present invention is also a method for pre-compressing a concrete structure. This method is conveniently implemented by means of a system having one or more of the characteristics indicated hereinabove. The method comprises the step of pressurizing an area 310 inside the first tubular element 31. This step comprises introducing a fluid (typically an incompressible fluid) into the inside area 310.

The method further comprises the step of applying the concrete around said first tubular element 31.

The step of waiting for at least partial curing of the concrete is also provided. The step of waiting for the at least partial curing of the concrete comprises the step of waiting for at least 10 hours (however, this is a function of the type of construction material used; for example, in the case of CSA cements or polymers other than concrete, the time needed to achieve curing could be much less and, in such cases, at least 5 minutes can be considered as the time needed to achieve curing).

The method further comprises the step of reducing pressure in the area 310 inside the first tubular element 31, thus bringing about a longitudinal contraction of the first tubular element 31. This takes place after the concrete has reached at least partial curing. All of this brings about a pre-compression of the concrete that envelops the first tubular element 31. Advantageously, the compressive action is brought about by the thrust pushing the first and the second head 21, 22 towards each other. The compression thus affects the concrete interposed between the first and the second head 21, 22. Though to a lesser degree, the pre-compressive action could be associated also with the adhesion between the first tubular element 31 and the concrete enveloping it.

The object of the present invention is also a method for realizing the first tubular element 31 of a system having one or more of the characteristics described hereinabove.

This method comprises the steps of:

arranging a central longitudinal core;

wrapping spirally at least a first fibre impregnated with a resin around said central core;

arranging a longitudinal fibre along said core (interweaving it with or crossing it over the first fibre).

The present invention offers important advantages.

First of all, it makes it possible to reduce costs and the operational complexity associated with pre-compression of concrete. This is reflected in the fact that pre-compression can also be adopted for realizing concrete structures of smaller dimensions compared to current dimensions.

The invention thus conceived is susceptible to numerous modifications and variants, all of which falling within the scope of the inventive concept characterizing the invention. Moreover, all details may be replaced with other technically equivalent elements. All the materials used, as well as the dimensions, may in practice be of any type, according to needs.

The invention claimed is:

1. A pre-compression system for pre-compressing a structure, which, in turn, comprises a construction material, said pre-compression system comprising a first tubular element (31) that is expandable in a longitudinal direction, said first tubular element (31) being movable between a longitudinally elongated configuration, in which a pressurized fluid is placed inside the first tubular element (31), and a contracted configuration, in which said fluid is at least partly removed, a passage from the longitudinally elongated configuration to the contracted configuration bringing about a compression on the construction material which at least partly envelops the first tubular element (31); wherein:

a) said first tubular element (31) comprises a composite material the composite material comprises a matrix and fibres located in the matrix, said fibres comprising fibres that are wrapped around a longitudinal axis and that extend helically; or -the first tubular element (31) comprises fibres, said fibres comprising impregnated fibres helically wrapped around the longitudinal axis;

b) the fibres also comprise longitudinal fibres which are responsible for a contraction of the tubular element which determines the passage from the longitudinally elongated configuration to the contracted configuration thus defining the pre-compression of the construction material; the first tubular element (31) has a resistance to radial expansion and a resistance to longitudinal elongation, wherein the resistance to radial expansion is greater than the resistance to longitudinal elongation.

2. The pre-compression system according to claim 1, characterized in that the pre-compression system comprises a first and a second compression head (21, 22) for compressing the construction material interposed between them, said compression on the construction material being performed by the first and the second head (21, 22) in the contracted configuration of the first tubular element (31).

3. The pre-compression system according to claim 2, characterized in that the pre-compression system comprises a second expandable tubular element (32) that extends from the first compression head (21) to a third compression head, said first and said second tubular element (31, 32) extending along different directions.

4. A method for pre-compressing a structure comprising a construction material, by means of the pre-compression system according to claim 1, and comprising steps of: -pressurizing an area (310) inside the first tubular element (31); -applying the construction material around said first tubular element (31); -waiting for at least partial curing of the construction material; -reducing pressure in the area (310) inside the first tubular element (31), thus bringing about a longitudinal contraction of the first tubular element (31) and a pre-compression of the construction material that envelops the first tubular element (31).

5. The method according to claim 4, wherein the step of pressurizing the inside area (310) comprises introducing a pressurized liquid inside the first tubular element (31) by pumping.

6. The pre-compression system according to claim 1, characterized in that a ratio of a weight or a strength of the fibres wrapped around a longitudinal axis of the first tubular element (31) to a weight or a strength of the longitudinal fibres is about 2 to 1.

* * * * *